United States Patent [19]

Snider

[11] 4,034,718

[45] July 12, 1977

[54] INTERNAL COMBUSTION ENGINE WITH ROTATING CHAMBERS

[76] Inventor: Ray S. Snider, 2505 East Ave., Rochester, N.Y. 14610

[21] Appl. No.: 650,717

[22] Filed: Jan. 20, 1976

Related U.S. Application Data

[63] Continuation-in-part of Ser. No. 470,033, May 15, 1974, abandoned.

[51] Int. Cl.[2] ..... F02B 55/00

[52] U.S. Cl. ..... 123/8.45; 418/265

[58] Field of Search ..... 418/161, 176, 264, 265; 123/44 D, 44 E, 43 R, 43 C, 8.4 S, 8.47

[56] References Cited

U.S. PATENT DOCUMENTS

| | | | |
|---|---|---|---|
| 1,400,255 | 12/1921 | Anderson | 123/8.47 |
| 3,364,908 | 1/1968 | Herpolsheimer | 418/176 X |
| 3,373,723 | 3/1968 | Blosser | 418/265 X |
| 3,438,358 | 4/1969 | Porsch et al. | 418/176 X |
| 3,793,998 | 2/1974 | Yokoi et al. | 418/265 X |

*Primary Examiner*—Carlton R. Croyle
*Assistant Examiner*—Leonard Smith
*Attorney, Agent, or Firm*—Stonebraker, Shepard & Stephens

[57] ABSTRACT

An internal combustion engine having a fixed casing or housing defining a cavity of circular cross section, and cam mechanism within the cavity near the center thereof. A rotor rotates in the annular space between the casing and the cam, and carries flaps which are moved by the cam mechanism as the rotor rotates, to form, in conjunction with the end walls and cross members of the rotor and the interior surface of the casing, combustion chambers of varying size. At one point in the cycle of rotation, the flaps of one chamber move to a position forming a rather large intake chamber, which receives a combustible mixture. Then, as rotation continues, the flaps are moved to make this chamber smaller to compress the combustible mixture; then the mixture is ignited, producing pressure within the chamber, which exerts force in a direction to cause the rotor to rotate relative to a fixed part of the cam mechanism; then the cam mechanism moves the flaps to decrease the size of the chamber to assist in exhausting the products of combustion; and finally as rotation continues to an inlet port, additional movement of the flaps allows entry of a fresh supply of the combustible mixture. Several embodiments are illustrated and described.

7 Claims, 13 Drawing Figures

INTERNAL COMBUSTION ENGINE WITH ROTATING CHAMBERS

CROSS REFERENCE TO RELATED APPLICATIONS

This application is a continuation-in-part of my application Ser. No. 470,033, filed May 15, 1974, allowed Oct. 21, 1975, and abandoned upon the filing of this application.

BACKGROUND OF THE INVENTION

This invention relates to an internal combustion engine which functions without the usual conventional cylinder containing a piston driven by the force of explosion of a combustible mixture within the cylinder, but which, on the contrary, has a rotor rotating in an annular space within a fixed casing, the rotor carrying pivoted flaps which cooperate with other parts to form chambers of varying size, the size of each chamber at any given instant being controlled by movement of the flaps under the influence of cam mechanism, at least part of which is located centrally in stationary position within a main chamber, the rotor rotating around the stationary part of the cam mechanism.

An object of the invention is the provision of a generally improved and more economical engine of the general type above indicated, with fewer parts and with reduction in weight and size.

Another object is the provision of such an engine hich is sturdy, has great reliability, has less friction and wear, and is economical to manufacture.

A further object is the provision of an engine which is suitable for use in a miniature form, such as for powering a model airplane, as well as being useful in intermediate and larger sizes for heavy duty commercial use.

DESCRIPTION OF THE PREFERRED EMBODIMENTS

Figure 3:
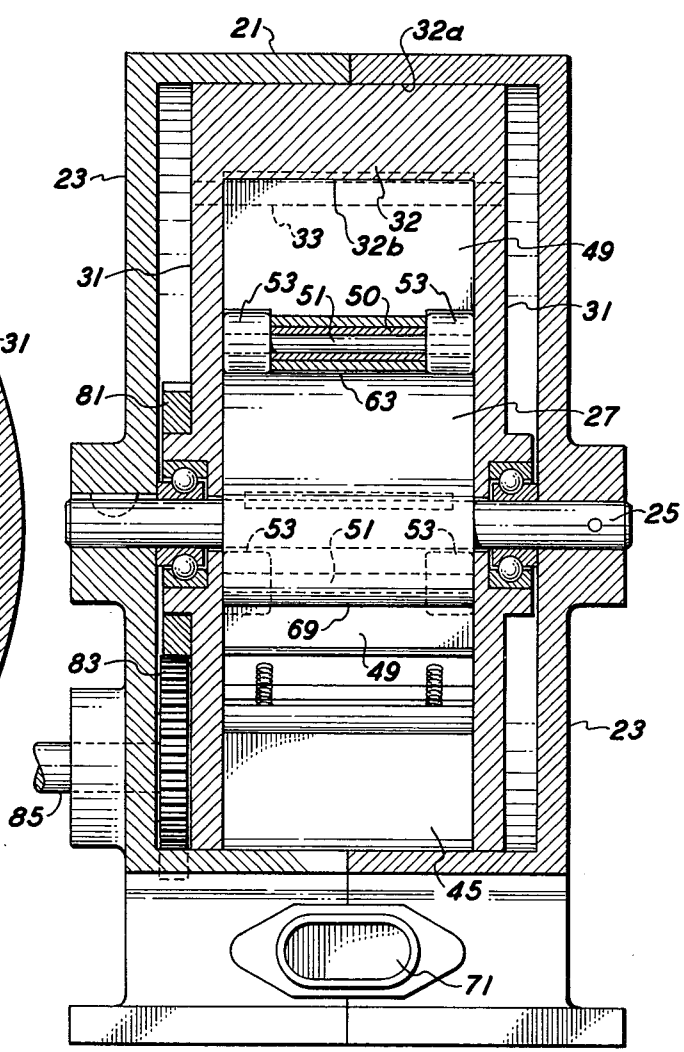
FIG. 3 is an axial section taken approximately on the line III—III of FIG. 1.
Figure 1:
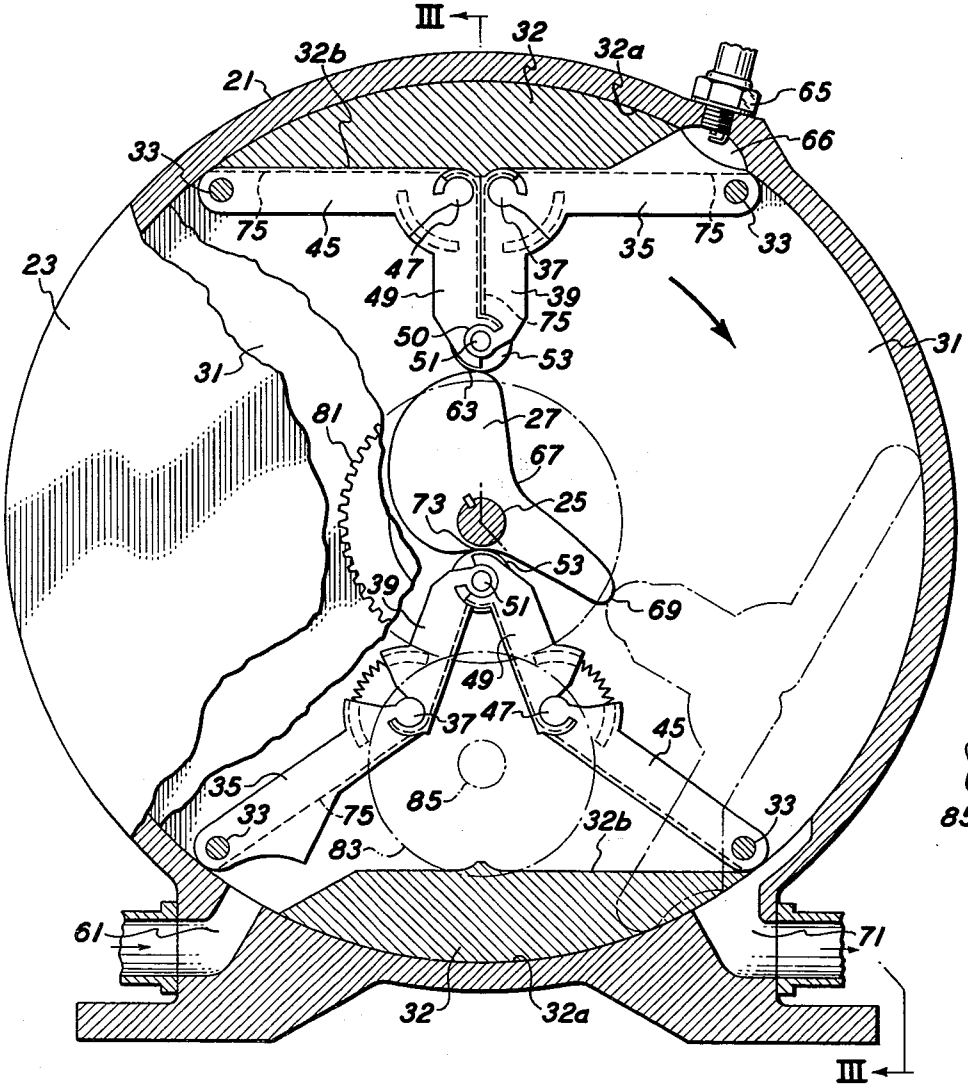
FIG. 1 is a cross section through an engine according to a first embodiment of the invention, showing the movable flaps in one position.
Figure 2:
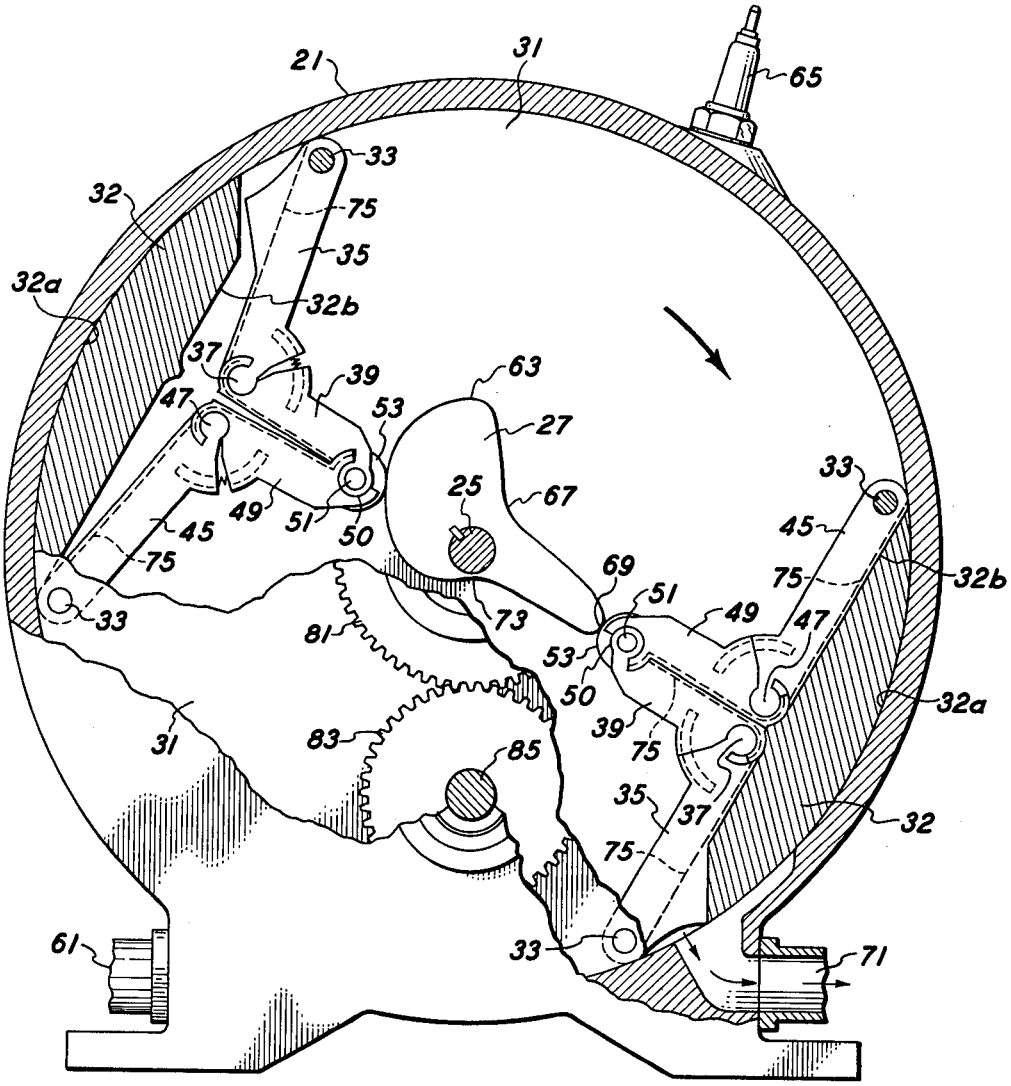
FIG. 2 is a similar view showing the position of the parts when the rotor has turned somewhat clockwise from the position shown in FIG. 1.

Referring now to the first form of the invention, illustrated in FIGS. 1–3, the structure comprises a main housing or casing 21 defining a cylindrical cavity or chamber of circular cross section, like the inside of a barrel. Suitable end walls 23 are provided. The exterior configuration of the housing can be of any suitable shape, and is not important for present purposes.

The housing is in fixed position. Extending axially through it, at the center, is a fixed shaft 25 having fixed thereon a cam indicated in general at 27, of irregular cross sectional shape. The shaft 25 and cam 27 can be made integrally of one piece if desired, although it is usually more practical to produce the cam separately and secure it in fixed position on the shaft. The ends of the shaft are fixed to and supported by the end walls 23 of the housing. All of these parts are stationary, during operation of the engine.

A rotor is mounted on the shaft to rotate within the chamber formed by the main housing parts 21, 23. This rotor has disk-like ends 31 placed just inside the end walls 23 of the stationary housing, and having suitable bearings on the shaft 25. The two end walls 31 of the rotor are connected to each other at spaced points by string connecting members 32, one for each combustion chamber, each connecting member having a curved outer face 32*a* conforming closely to but not quite touching the inner face of the fixed housing 21, and having an inner face, largely flat as at 32*b*, which forms one wall of the associated combustion chamber. The end walls of the rotor are also connected by pivot rods or struts 33, spaced at intervals circumferentially around the rotor disks 31. There are two such struts 33 for each expansion chamber of the engine. Hence if the rotor is designed for two expansion chambers, there would be two connecting members 32 and four struts 33. Depending on the size of the engine, it can be designed for three or four expansion chambers.

These struts 33 and connecting members 32 serve to connect one rotor end plate 31 rigidly with the other rotor end plate, providing a rotary structure somewhat similar to a squirrel cage. The struts 33 also serve as pivots for the pivoted flaps which form movable wall portions of expansion chambers where the combustion of the fuel mixture takes place. Since all the expansion chambers are of the same construction, a description of one will suffice for all.

As part of each chamber there are two flaps, a leading or fore flap, and a trailing or aft flap, forming the chamber in conjunction with the end walls 31 of the rotor and the inner face 32*b* of the associated member 32. In some cases, each flap may consist of a single integral component, but in the preferred construction, each flap is an assembly of two flap components, pivotally connected to each other as in the embodiment illustrated in FIGS. 1–3, or telescopically sliding with respect to each other as in the embodiment illustrated in FIG. 4, or as a single component illustrated in FIG. 5, which will be further described below.

In the first embodiment (FIGS. 1–3) each fore flap comprises an outer flap component 35 pivotally mounted at its outer end of one of the struts 33 just in front of (clockwise with respect to) the leading edge of the connecting member or cross member 32, and pivoted at its inner end at 37 to an inner flap component 39. The trailing or aft flap like-wise comprises an outer flap component 45 having its outer end pivoted on one of the struts 33 just to the rear of the trailing edge of the member 32 and having its inner end pivotally connected at 47 to the inner aft flap component 49. The inner end of the fore flap component 39 is pivotally connected to 50 to the inner end of the aft flap component 49. All these pivotal connections of the various flap components to each other are preferably formed by socket joints, as schematically shown in the drawings, rather than by hinge pins, since socket joints provide better tight sealing of the combustion chamber. Near its inner end the flap component 39 carries a pivot 51 on which there are one or more rollers 53 which ride on the surface of the cam 27 which serves to control the folding and unfolding motions of the flaps to enlarge or diminish the size (capacity) of the chamber formed in part by the flaps.

Assuming that there are only two combustion chambers, as illustrated in FIGS. 1 and 2 (although there could be more than two chambers, as above mentioned) the description may start with the flaps in the position shown in FIG. 1. Considering for the moment only the lower chamber, for ease of presentation, it is seen that the roller 53 is at the lowest point of the cam 27, so that the flaps are opened up or expanded to form a chamber of maximum size. This is the intake position. In this position, the chamber is in communication with an inlet or intake port 61, and as the chamber was expanding in size (shortly before reaching the position illustrated in FIG. 1) the fuel mixture was sucked into the expanding chamber. As the rotor continues its clockwise rotation beyond the position shown in FIG. 1, the aft flaps 45 and 49, forming the trailing edge of the chamber, pass the fuel intake port 61 and so the chamber is now cut off from all external communication. As rotation continues, the rollers 53 ride up a rising portion of the cam 27, so that the roller 53 is forced radially outwardly, folding the flaps to decrease the size of the chamber as the roller 53 approaches the high point of the cam 27, this high point being indicated by the numeral 63. This action may be likened to the compression stroke of a conventional cylinder and piston engine. The fuel mixture within the chamber (that is, confined between the flaps, the cross member 32, and the end walls 31 of the rotor) is compressed, during this part of the rotation, to a relatively high compression.

Just as the roller 53 reaches the high point 63 of the cam and is ready to start its descent on a downwardly sloping portion of the cam, the chamber has come around so that the compressed mixture in the chamber is now opposite an ignition plug 65 stationarily mounted in a recess 66 in the housing 21. This can be either a glow plug constantly at ignition temperature, or a conventional spark plug fired by any suitable conventional spark plug firing mechanism at the instant the compressed mixture reaches the plug, so that the compressed mixture in the chamber explodes, creating great pressure and thus tending to expand the chamber. The only means of expansion is by pushing radially inwardly on the roller 53, which now starts its descent along the steep downwardly sloping part of the cam 27, the radially inward pressure of the roller 53 reacting against the descending slope of the cam to create a turning force transmitted to the pivot struts 33 on which the flaps are pivoted, thereby tending to turn the support disks 31 in a clockwise direction. This produces the driving force to turn the rotor.

When the roller 53 reaches the low point 67 of this portion of the cam, the driving force is expended or completed so far as this particular cycle is concerned, and the roller starts to ride up another rising portion of the cam between the low point 67 and the next high point 69. At this time exhaustion through the exhaust port 71 occurs. The action of the roller in riding up the cam rise between the points 67 and 69 again folds the flaps in a radial outward direction (similar to the action during the compression stroke) and forces the products of combustion out through the exhaust port 71, which is now opposite the flaps at this time. The exhaust stroke is completed when the roller reaches an elevated point 69 of the cam, and then as it goes down the descending part of the cam between the high point 69 and the low point 73, the chamber expands and sucks in the fuel mixture through the inlet port 61. Or if preferred, the fuel may be injected under pressure through a conventional fuel injection nozzle.

The intake part of the cycle is at maximum when the roller 53 reaches the low point 73 of the cam. Then the roller rides up the slope to the high point 63, compressing the fuel mixture during the compression portion of the cycle, and the cycle is repeated as above described.

The radially outward ends of the flaps 35 and 45 (that is, the ends which are pivoted on the struts 33) fit snugly against the smooth circular inner surface of the housing or casing 21, and the axial ends of all of the flaps fit snugly against the end disks 31 of the rotor. In addition, suitable seals of any conventional kind are provided so that the chambers are tightly sealed, at these points just mentioned, and also at the joints 37, 47, and 51. For example, the seals between the axial ends of the flaps and the inner faces of the rotor disks 31 may be similar in principle (except for shape) to the piston rings used on conventinal cylinder and piston engines. That is, there may be grooves in the ends of the flaps adjacent the rotor plates 31, and metal strips in these grooves may be pressed outwardly into tight sliding engagement with the inner faces of the disks 31, by springs placed under the metal strips. The seals are shown schematically at 75.

As above explained, the successive explosions or firings of the compressed mixture in the chambers serve to drive the flap rollers 53 radially inwardly toward the shaft 25, and since the rollers at this time react against a cam slope between the high point 63 and low point 67, the inward pressure of the rollers tends to make the rollers travel down the slope of the cam, thereby producing a torque in a clockwise direction, although it can be designed for counterclockwise direction. The rotation of the rotor is transferred by any suitable gearing to the point where power is desired. For example, one or both rotor end disks 31 may have gear teeth on its peripheral edge, or preferably on its outer axial face. Such gear teeth are shown at 81 in FIG. 3, and a gear or pinion 83 meshing with such gear teeth 81 transmits the power to a shaft 85 from which the power is taken to any desired place.

This engine has the advantage that it needs no valve mechanism whatever, since the inlet and exhaust functions are performed by the fact the chambers formed in part by the folding flaps successively pass, during their rotation, the inlet port, the ignition plug, and the outlet port. These ports are fixed orifices in the stationary housing 21, so the engine eliminates all need for a cam shaft, valves, valve seats, valve tappets, etc. Also, the ignition is simplified as compared with a conventional engine, since a single ignition plug will serve for all of the combustion chambers which successively pass the ignition point, and since only a very simple form of distributor is needed if it is decided to use a spark plug rather than a glow plug.

An engine constructed on these principles has proven quite satisfactory in small sizes used, for example, in model airplanes. No reason is seen why it should not be equally successful in larger sizes, useful for example in driving motor vehicles, aircraft, marine craft, or various kinds of machinery.

Figure 4:
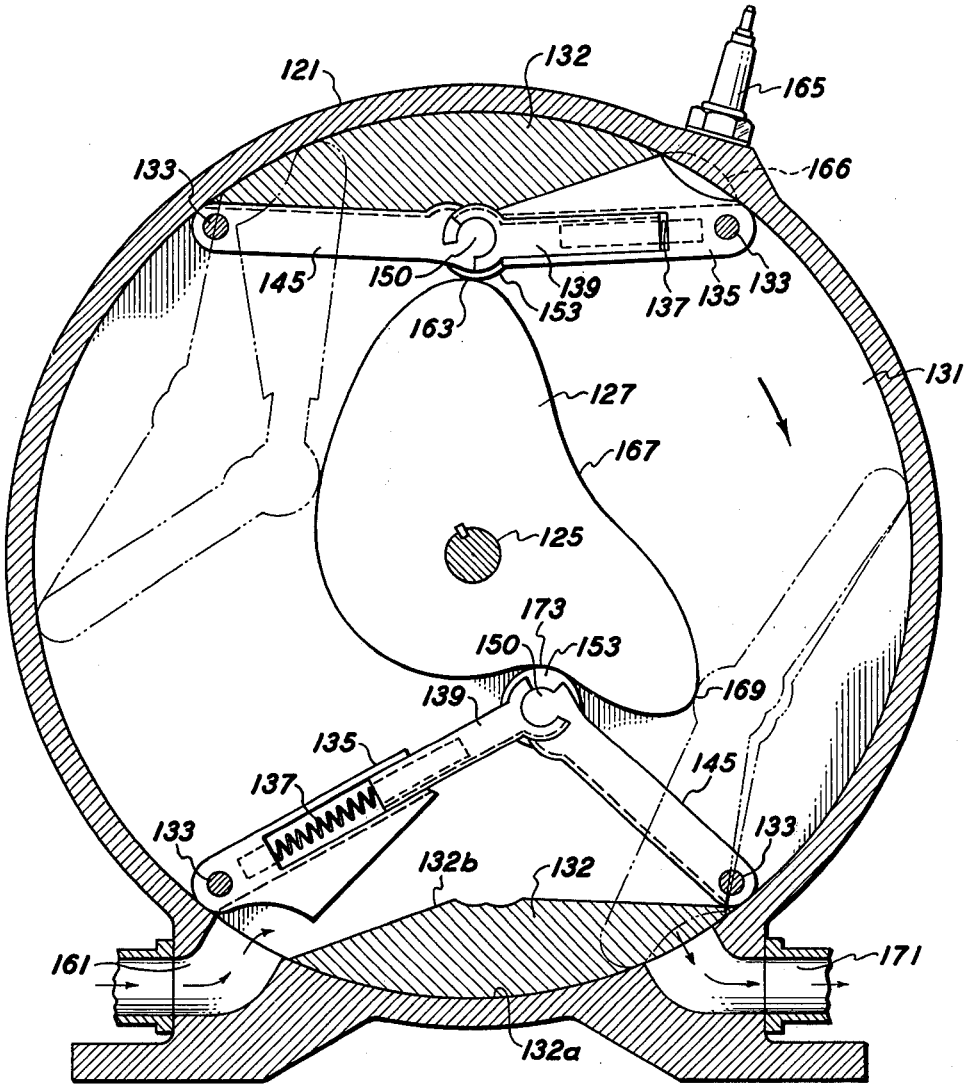
FIG. 4 is a cross section similar to FIG. 1, illustrating an alternative construction of the flaps.

Referring now to the modified or alternative embodiment illustrated in FIG. 4, the construction is basically the same as above described except for the use of flaps of a different form. The stationary housing or casing is shown at 121, the central shaft at 125, and the cam in general at 127. The cross connectors are 132, and the struts which connect the end plates 131 of the rotor and serve as pivots for the flaps are shown at 133. In this modification, the leading or fore flap is made of an outer flap component 135 and an inner flap component 139 which have a telescopic sliding fit with each other, as illustrated, rather than being pivoted to each other as in the previous embodiment. In one respect this is better, in that it somewhat simplifies the tight sealing of the flaps 135 and 139 to each other, but it has the disadvantage of creating additional friction at this point, as compared with the pivoted joint 37 oin the previous embodiment. Springs 137 tend to push these components apart.

The trailing or aft flap, in this modified embodiment, is made of a single unitary rigid flap 145. Here, again, there is no problem of sealing two flaps to each other at a pivotal joint, as was necessary at 47 in the previous embodiment. The inner end of the flap 139 is pivoted to the inner end of the flap 145 at 150, and near this joint there is an axle for the roller 153 rolling on the periphery of the cam 127.

Except for this difference in the construction of the flaps, and for some modification of cam shape, and connecting member, this embodiment in FIG. 4 is basically the same as the embodiment previously described in conjunction with FIGS. 1–3. The cycle of operation is the same.

Figure 5:
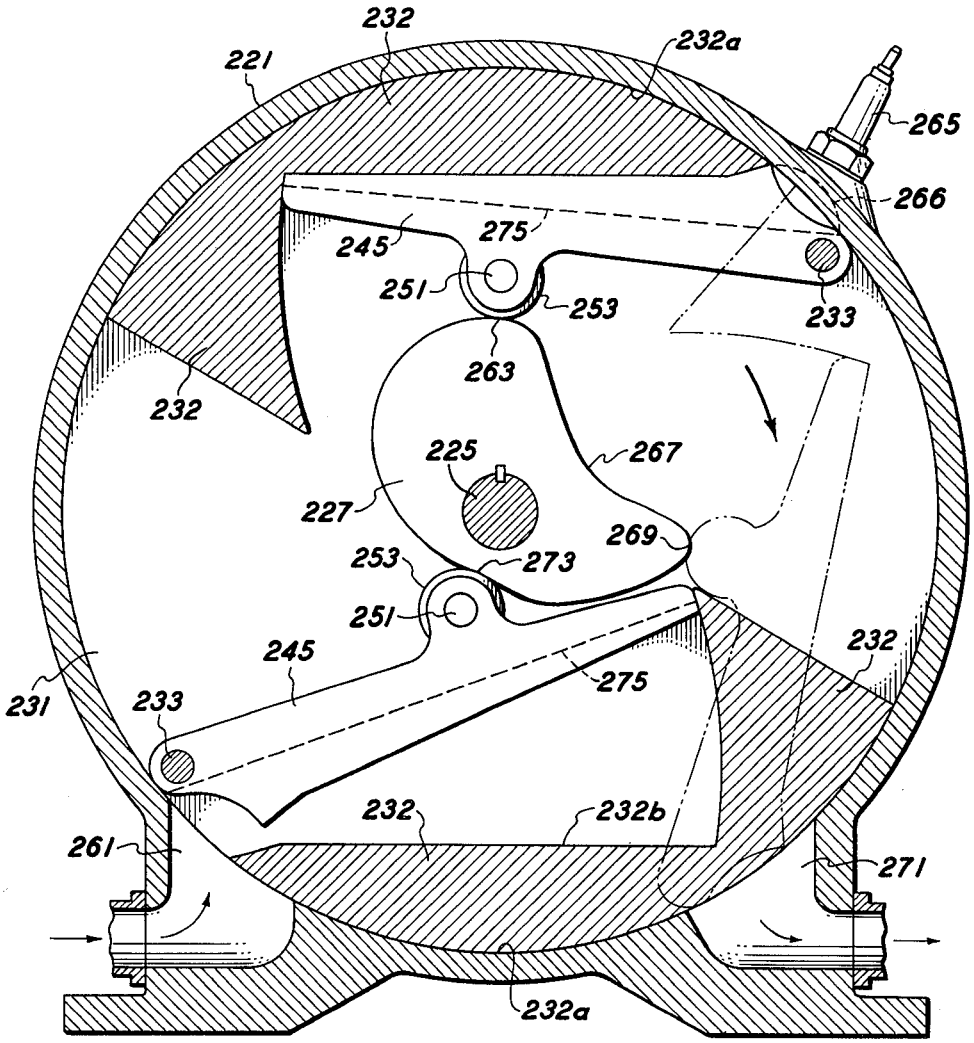
FIG. 5 is a similar view illustrating still another alternative construction of the flaps.

The modified or alternative embodiment illustrated in FIG. 5 is basically the same construction as described above except for the use of a simplified flap design, and some change in the shape of the cross connecting members. The stationary housing or casing is shown at 221, the central shaft at 225, and the cam in general at 227. The main cross members are 232, and struts on which the flaps are pivoted are at 233. In this modification the functions of the fore and aft flaps are combined in a single rigid unitary flap 245, rather than being made up of various flap components as shown in FIG. 4 or FIGS. 1—3. This results in the use of fewer moving parts and more simple design and is adequate for engines of low horsepower. The axle 251 for the roller 253 rolling on the periphery of the cam 227 is attached to the undersurface of the flap 245.

Except for this difference in flap construction and some modification of the shape of the cam and the connecting members, this embodiment in FIG. 5 is basically the same as that previously described in conjunction with FIG. 4. The cycle of operation is the same.

In general, the parts in FIG. 4 which correspond approximately to parts in FIGS. 1–3 use the same reference numerals with the addition of 100 to each, and the parts in FIG. 5 use the same reference numerals with the addition of 200 to each. It is therefore unnecessary to describe many of these parts in FIGS. 4 and 5 in detail, the use of reference numerals as above described being sufficient.

Reverting to FIGS. 1–3, there are equalizer springs 76 which tend to keep the inner and outer flap components in proper relation to each other. It will be noted that when the flaps are in compression position (top of FIG. 1) they fit rather tightly against the surface **32*b* of the cross members 32, and the same is true also of the alternative flap constructions in FIGS. 4 and 5**.

Figure 6:
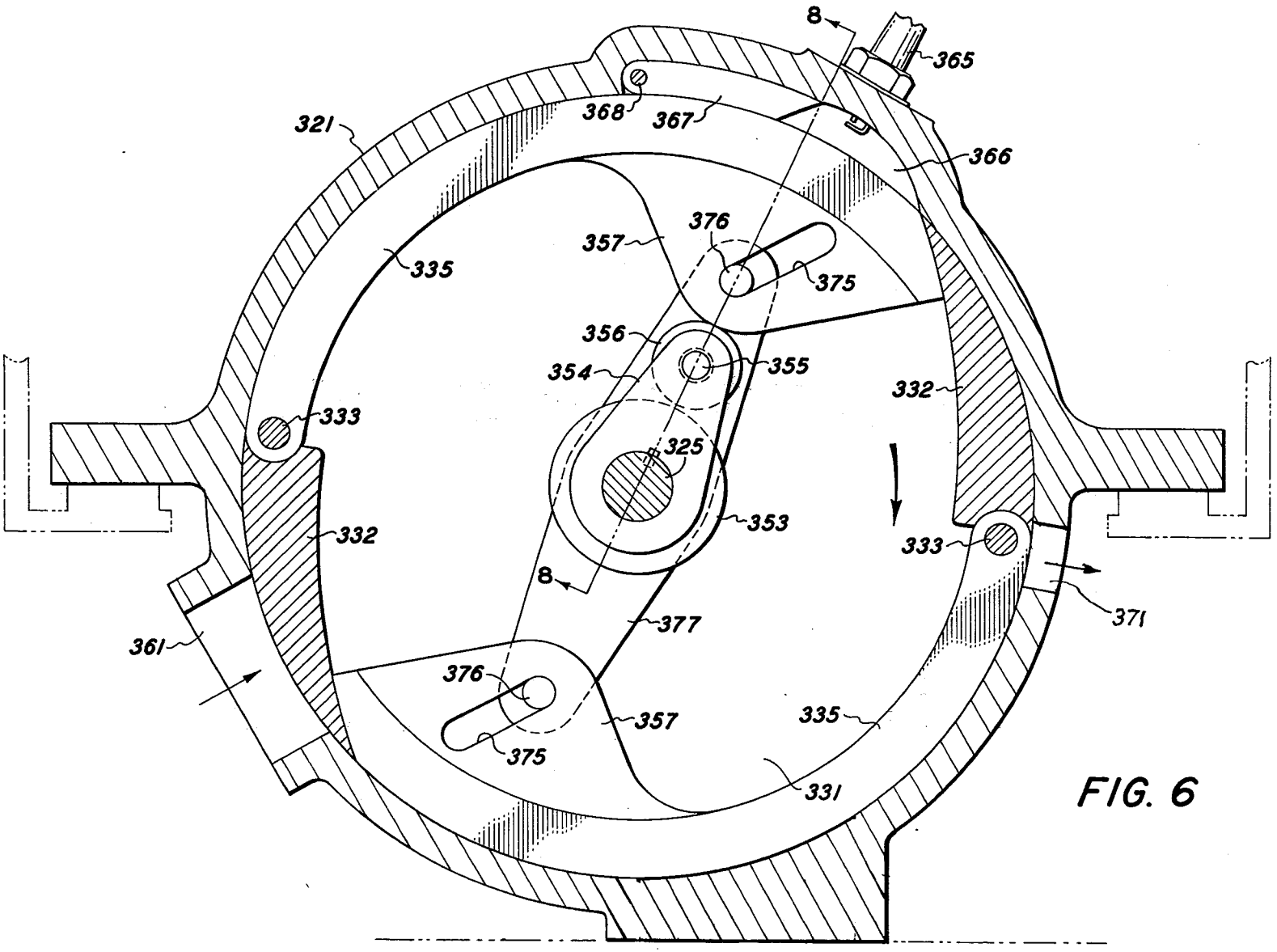
FIG. 6 is a view similar to FIG. 1 illustrating another embodiment of the invention.
Figure 7:
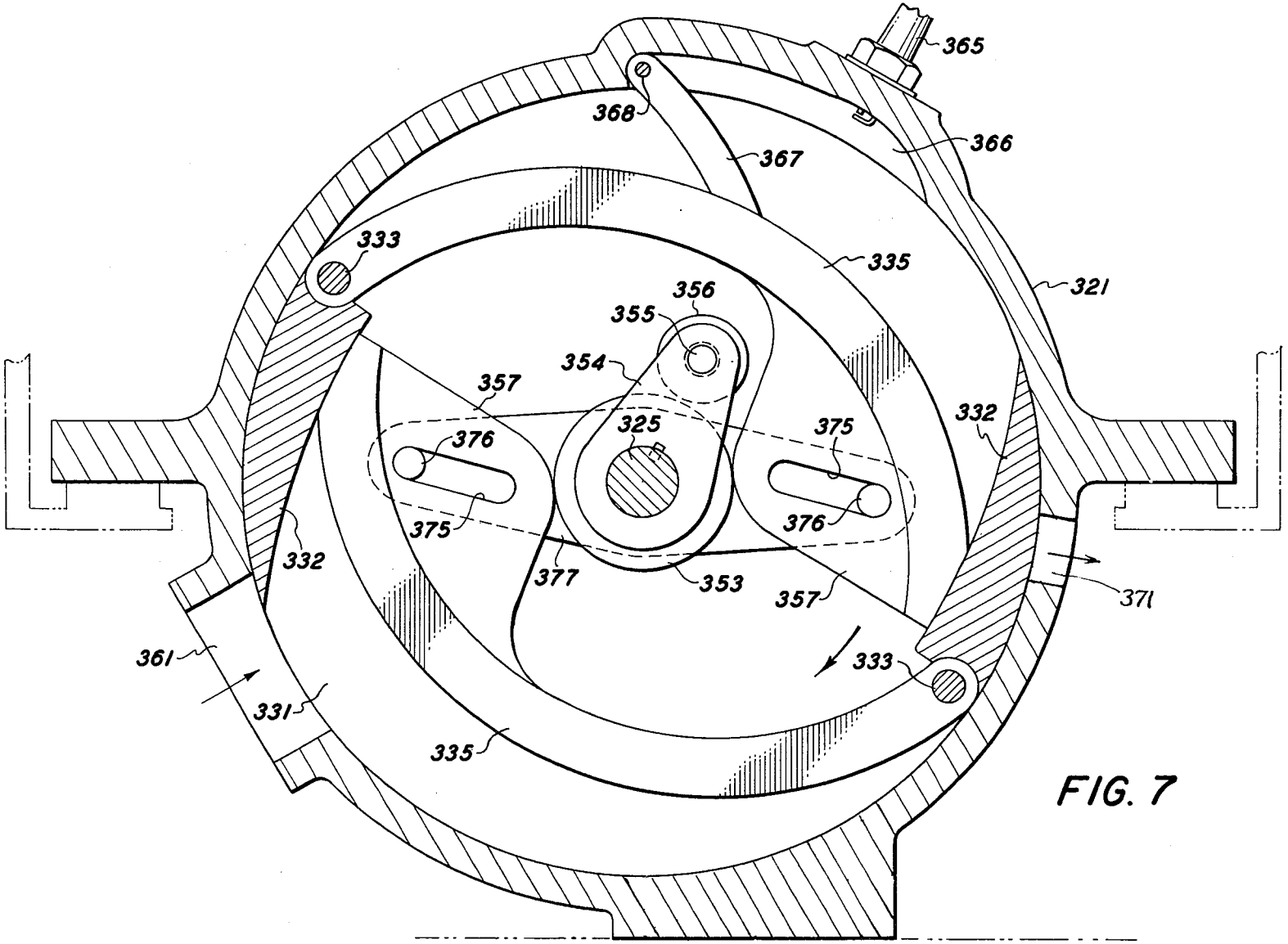
FIG. 7 is a similar view of the embodiment of FIG. 6 with the parts in a different position.
Figure 8:
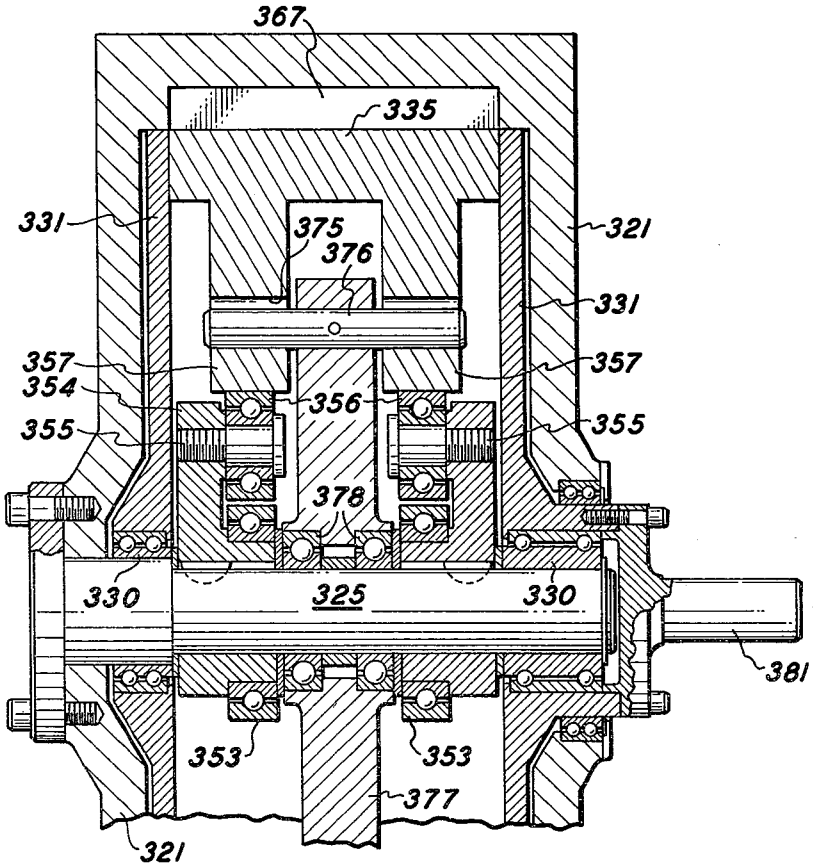
FIG. 8 is a fragmentary axial section taken approximately on the line 8—8 of FIG. 6.

Another embodiment of the invention is illustrated in FIGS. 6, 7, and 8. As before, this embodiment includes a stationary housing or casing 321, and a rotor rotating within the housing on a fixed shaft 325. The two parallel side plates 331 of the rotor rotate on suitable bearings 330 on the stationary shaft. The main cross members which rigidly connect one side plate 331 to the other side plate are shown at 332, and may be referred to as fins or struts or connectors. They are tapered in cross section, from a very thin trailing edge to a rather thick leading or forward edge, as well seen in FIGS. 6 and 7.

In addition to these fins 332, other cross members or struts between the two side plates of the rotor are in the form of rods or shafts 333, which serve as bearings for the pivoted flaps 335. Each pivoted flap is in the form of a curved segment pivoted on its respective shaft 333 at its rear or trailing edge, the forward or leading edge of the flap engaging slidably against the inner face of the fin 332 on the opposite side of the rotor. The inner face of the fin 332 is curved concentrically with the shaft 333 at the opposite side. The flap 335, when swung radially outwardly (with respect to the central shaft 325), is substantially in contact with the inner cylindrical face of the stationary casing 321, in the position shown in FIG. 6. When the flap swings inwardly, toward the central shaft 325, it assumes the position shown in FIG. 7. Just as in the previous embodiments, the side or lateral edges of each flap 335 are substantially engaged with the flap side walls 331 of the rotor, suitable sealing means being provided, on the same principle as piston rings in a piston engine, as already mentioned in connection with the previous embodiments. Similar sealing means is employed between the forward end of each flap 335 and the corresponding arcuate surface of the fin 332 with which it engages.

In the previous embodiments, the torque resulting from combustion in the combustion chamber was produced by the inner action of the flaps with a central disk or cam member 27 or 127 or 227. In the present embodiment, the torque is transmitted by interaction of the flaps with what may be called cam mechanism, but instead of the fixed cam disk as used in the previous embodiments, the cam mechanism in this embodiment comprises two fixed rollers. By this expression "fixed rollers" is meant that the axis of rotation of each roller is in a fixed or permanent position (not rotating with rotation of the rotor) but each roller does rotate on its own axis.

The first of these rollers is indicated at 353, and rotates on the fixed central shaft 325. Actually, there are two of these rollers 353, axially separated from each other as shown in FIG. 8. Fixed non-rotatably on the shaft 325 are a pair of axially separated arms 354, parallel to each other, and these arms carry laterally projecting pivot pins 355 on which the rollers 356 are mounted. This construction is well illustrated in FIG. 8. It is seen that the rollers 356 are axially separated from each other, and are in the same transverse plane (perpendicular to the shaft 325) as the rollers 353. In fact, the rollers 353 may have their bearings on hub extensions on the fixed arms 354, rather than bearing directly on the shaft 325. The result is the same, since the shaft 325 and the arms 354 are fixed relative to each other.

These rollers 353 and 356 cooperate with flanges 357 formed integrally with the respective flaps 335 and projecting inwardly (toward the central shaft 325) from the inner surface of each flap. The inner edges of these flanges 357 have a cam configuration as illustrated in FIGS. 6 and 7. These cam flanges 457 together with the cooperating rollers 353 and 356 constitute the cam mechanism, and it will be seen that, viewed from one standpoint, this cam mechanism is in the nature of a reversal of the cam mechanism in the previous embodiments. In the previous embodiments, rollers on the pivoted flaps cooperate with a fixed cam. In the present embodiment, cams on the pivoted flaps cooperate with fixed rollers, that is, rollers which rotate on fixed axes.

The cam flanges 357 have control slots 375 which slidably receive cross pins 376 extending through these slots in directions parallel to the central shaft 325, the pins being mounted near opposite ends of a diametrical control arm or lever 377 mounted on bearings 378 to rotate on the fixed central shaft 325. The control slots 375 are at such angles that when one of the flaps 335 is in its outermost position (for example, the top flap in FIG. 6) the slot 375 acting on the corresponding pin 376 swings the control lever 377 to a position which holds the outer flap (for example, the lower flap in FIG. 6) likewise in its outermost position. As the rotor of the motor rotates to the position shown in FIG. 7, with the upper flap 335 in its innermost position (as a result of the combustion or explosion occurring in the combustion chamber above this upper flap), the inward motion of the slot 375 acting on the pin 376 turns the arm or control lever 377 slightly relative to the flap, so that the corresponding pin 376 at the opposite end of the control arm 377 reacts with its slot 375 to pull its flap (the lower flap 335 in FIG. 7) inwardly to the position illustrated.

As in previous embodiments, the fixed casing or housing has a fuel inlet port 361 and an exhaust port 371. It also has an ignition device 365 which, as in the previous embodiments, may be in the nature of an ordinary spark plug, or a glow plug. The ignition device 365 is mounted in a small chamber 366 (corresponding to the chambers 66 and 166 and 266 in the previous embodiments) which chamber is partially occupied at times by an auxiliary flap 367 pivoted on a pivot 368 to swing from the extreme outward position shown in FIG. 6 to the extreme inward position shown in FIG. 7.

The operation of this form of the invention is as follows: assume that the rotor is rotating clockwise when viewed as in FIGS. 6 and 7, and that the parts are in the position shown in FIG. 6. Highly compressed fuel is in the chamber 366. The ignition device 365 causes combustion or explosion of this fuel, creating great pressure in the chamber 366, tending to push the upper flap 335 inwardly toward the center of the rotor. As the flap moves inwardly, the cam flange 357 (when the rotor has rotated just a trifle beyond the position shown in FIG. 6) reaches the point where the rear or aft inclined thereof rides down the roller 356, the pressure of the cam against the roller creating a torque effect tending to move the flap 335 in a clockwise direction, this force being transmitted through the pivot 333 to the rotor so that the entire rotor turns in a clockwise direction. As the upper flap 335 moves inwardly, the action of its control slot 375 on the control member 377 causes the opposite or lower flap 335 likewise to move inwardly as the rotor continues its rotation, and just about this time the trailing edge of the corresponding fin 332 of the rotor uncovers the fuel inlet port 361, so that as the lower flap 335 moves inwardly, fuel is sucked in to the space below it.

As rotation continues, the trailing inclined surface of the cam flange 357 of the upper flap passes beyond the roller 356 and engages the roller 353, thus maintaining the upper flap in its innermost position (closest to the shaft 325) for some time. During this interval, the forward or leading edge of the cam flange 357 on the other pivoted flap (the flap which is the lower one in FIG. 7) comes around into contact with the roller 356, which cams this flamp (which has now become the upper flap) to its outward position, compressing the fuel mixture ready for the next combustion or explosion. As this flap moves outwardly under the cooperative influence of the forward or leading cam edge and the roller 356, the action of the control lever or link 357 moves the opposite flap outwardly, to expel the spent or burned fuel mixture out through the exhaust port 371. The cycle is then repeated.

As the upper flap is forced inwardly by the combustion of the fuel, the auxiliary flap 367 swings down from the position shown in FIG. 6 toward the position of FIG. 7, closing off the rear or trailing portion of the chamber between the flap and the housing, to keep the combustion chamber fairly small, for more efficient operation.

Power may be taken from the rotation of the rotor by means of a power take-off shaft 381 (FIG. 8) bolted to the hub portion of one of the side plates 331 of the rotor. Alternatively, power may be taken off through the use of gears similar to the gears 81 and 83 used for power take off in the embodiment previously described in connection with FIGS. 1–3.

Another embodiment of the invention will now be described in connection with FIGS. 9–13 of the drawings. In this embodiment, there are four pivoted flaps, one for each of four combustion chambers, so that four combustion cycles of compressed fuel occur during one single revolution of the rotor, but a greater or lesser number can be used if desired.

As before, there is a central shaft 425 which remains stationary during operation of the engine, and a fixed or stationary housing or casing encircling this shaft, the housing having a circular wall 421 the inner surface of which is of cylindrical form concentric with the shaft 425, and end walls 423 the inner faces of which are parallel to each other and perpendicular to the shaft 425 and spaced from each other in a direction axially of the shaft.

As in the previous embodiments, there is a rotor which rotates on the shaft 425, on suitable bearings 430, the rotor having two side plates 431 just inside the side walls 423 of the housing. The inner faces of these rotor side plates 431 are smooth and parallel to each other, and perpendicular to the axis of the shaft 425, as true also of the rotor side plates of the embodiment described in connection with FIGS. 6–8.

The two side plates of the rotor are rigidly connected to each other by cross members or struts in the form of fins 432, and also by struts in the form of rods or shafts 433, there being one fin 432 and one rod 433 for each combustion chamber. The side plates 431 together with the struts 432 and 433 make up a rigid rotor structure somewhat similar to a squirrel cage.

The flaps 435, one for each combustion chamber, are pivoted at their rear or trailing edges on the shafts 433, while thier leading or forward edges are closely adjacent to and make sealing contact with the trailing surfaces of the adjacent fins 432. The lateral edges of the flaps 435 are close to and make sealing contact with the inner faces of the rotor side plates 431. As previously mentioned in connection with other embodiments, tight seals are provided by use of any suitable or conventional sealing means, such as by metal or composition strips set into grooves in the lateral and the forward edges of the flaps 435, such sealing strips being urged outwardly from their grooves by spring means. Such a construction is shown as an example at one place in FIG. 11, where the groove is indicated at 436, the metal or composition packing material or sealing strip 437, and the spring at 438. All of the other seals may be of similar construction, and it is believed unnecessary to illustrate them in each location where they would be used.

Figure 11:
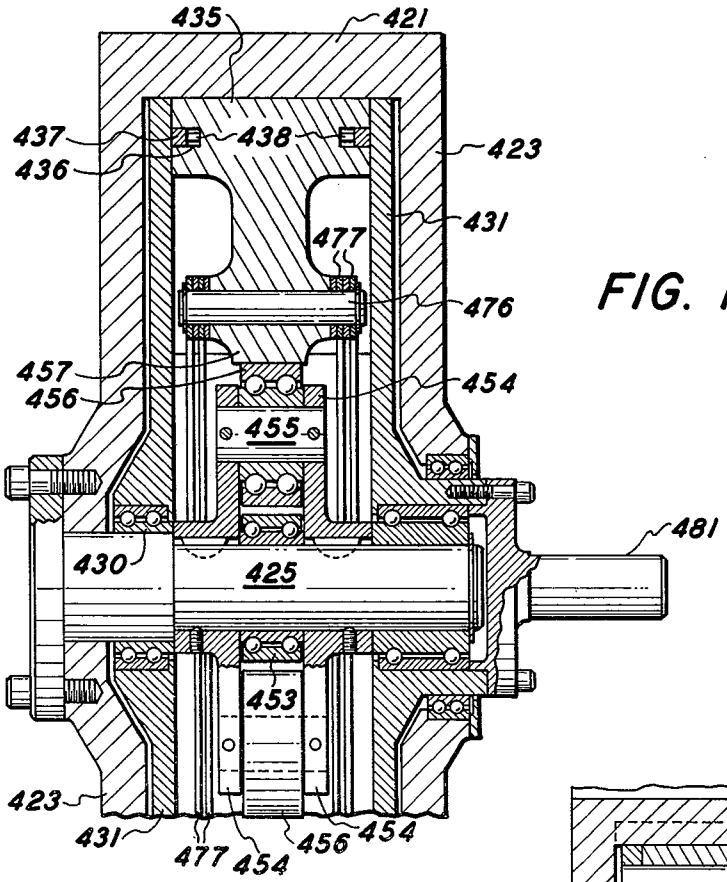
FIG. 11 is a fragmentary axial section taken approximately on the line 11—11 of FIG. 9.
Figure 12:
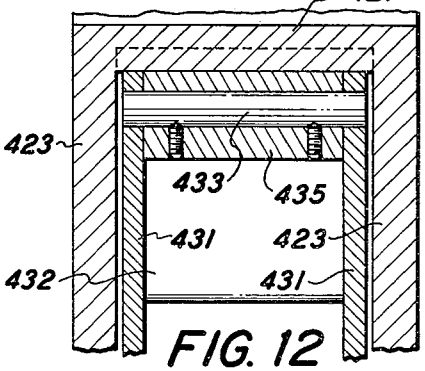
FIG. 12 is a fragmentary section approximately on the line 12—12 of FIG. 9.
Figure 13:
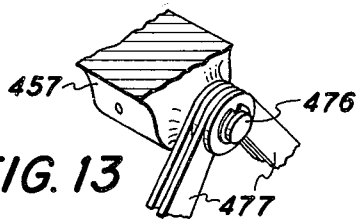
FIG. 13 is a fragmentary perspective view illustrating a detail of the embodiment shown in FIGS. 9–11.

In a manner somewhat similar to the embodiment of FIGS. 6–8, but differing therefrom in several details, the cam mechanism of the present embodiment comprises a central roller 453 rotating on the shaft 425, and a pair of arms 454 fixed to the shaft 425 and extending diametrically with respect to this shaft. The two diametrical arms are axially separated from each other (with the central roller 453 between them, as seen in FIG. 11) and at both of the opposite ends of these pairs of arms, there is a cross pin 455 on which a roller 456 rotates.

Thse rollers 453 and 456 of the cam mechanism cooperate with cam flanges 457 projecting inwardly from the inner faces of the flaps 435. In addition to having cam edges or control edges for cooperating with the rollers, the flanges 457 also have cross pins 476 parallel to the shaft 425 and projecting at both ends from the flanges 457. On these projecting ends of the pins 476 there are pivotally mounted the ends of control links or connecting members 477 which connect each flap to the next adjacent flap on each side thereof, a clearly seen in FIGS. 9 and 10.

As in the previous embodiment, there is an ignition chamber 466 at one point in the periphery of the wall 421, this chamber having an ignition device 465 such as a spark plug or a glow plug. An auxiliary flap 467, pivoted at 468 at its trailing or counterclockwise end, operates like the auxiliary flap 367 in the previously described embodiment.

The housing has a fuel intake port 461 and an exhaust port 471. It should be mentioned here that in all embodiments of the invention, fuel can be injected under pressure from a conventional fuel injection nozzle, if preferred, instead of merely sucking in a mixture of vaporized fuel and air through the intake port.

As in the previous embodiment, power may be taken from the power take-off shaft 481 (FIG. 11) coaxial with the stationary shaft 425 and bolted to one of the side plates 431 of the rotor. Alternatively, a gear arrangement for power take off may be used, similar to the gears 81 and 83 in FIGS. 1–3.

The operation of this form of construction will be clear from what has been said about the previously described embodiments, but may be briefly summarized as follows.

Figure 9:
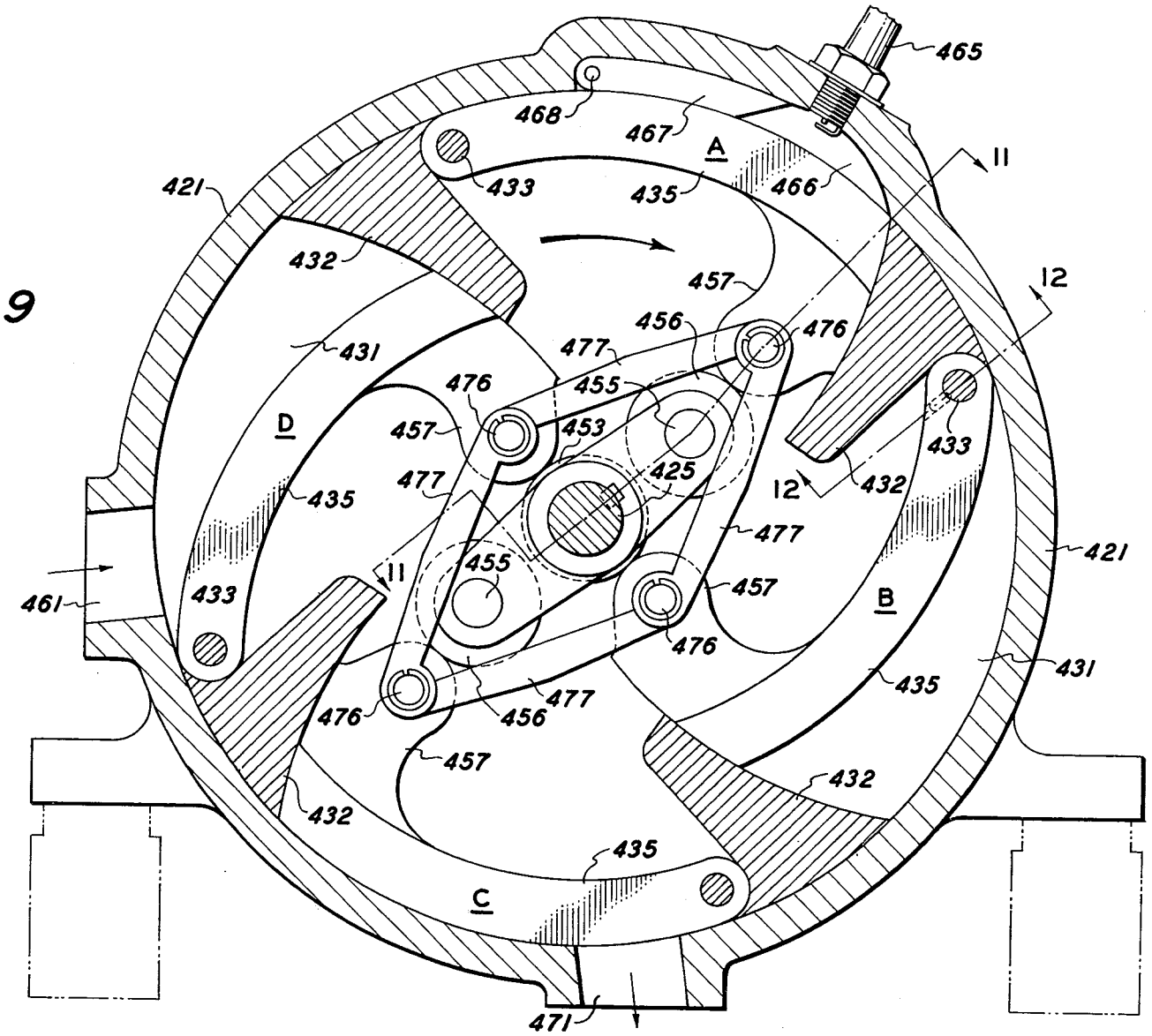
FIG. 9 is a cross section through an engine according to still another embodiment of the invention, with the movable parts in one position.

Assume that the parts are in the position illustrated in FIG. 9, and that the rotor is rotating in a clockwise direction. Merely for convenience of description of the operation, the pivoted flaps 435 will be additionally designated in FIGS. 9 and 10 by the letters A, B, C, and D, starting with the flap which is uppermost in FIG. 9 and proceeding clockwise. In the position of FIG. 9, flap A is in its fully compressed position or maximum outward position, and the same is true of the diametrically opposite flap C, while flaps B and D are in their extreme limit inward positions. The contact of the cam faces or control faces of the flanges 457 on flaps A and C with the respective upper and lower rollers 456 has caused these flanges to assume their maximum outward positions as illustrated, and the action of the control links 477 when the flaps A and C move outwardly has caused the flaps B and D to be drawn inwardly until the cam or control edges of their flanges 457 are in contact with the central roller 453.

The combustion or explosion in the ignition chamber 466 causes the fuel trapped and compressed by the flap A to expand, thus tending to force the flap A inwardly toward the central shaft 425. The control or cam surface on the flange 457 of this flap A therefore rides down the descending slope of the periphery of the roller 456 with which this flap is in contact. The expanding mixture above the flap remains trapped by the flap, as it moves inwardly, because the side edges of the flap are sealed against the inner faces of the side walls 431 of the rotor, while the forward edge of the flap is sealed against the corresponding face of the adjacent fin 432, which face is concentric with the pivot 433 of the flap.

Figure 10:
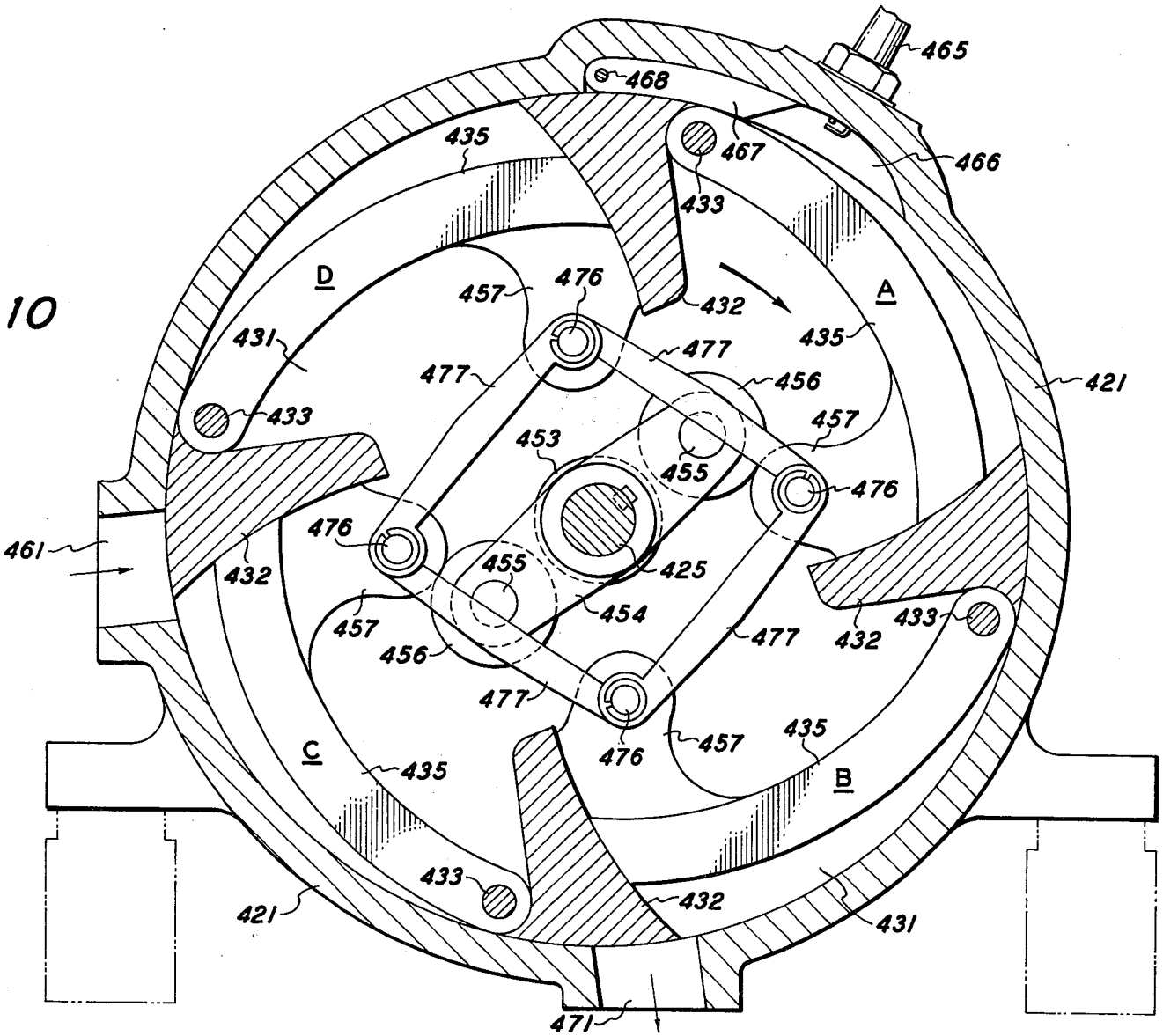
FIG. 10 is a view similar to FIG. 9 with the parts in a different position.

FIG. 10 illustrates the rotor slightly rotated a bit clockwise from the position shown in FIG. 9. As the flap moves inwardly, the reaction between the flange 457 of the flap A and the roller 456 in contact therewith requires the flap to move clockwise relative to the stationary parts 421 and 425, and this clockwise pull on the flap A pulls in a corresponding direction on its pivot 433, thereby transmitting force to the rotor to rotate this rotor in a clockwise direction.

As the flap A moves inwardly, the control links 477 push the flap B outwardly, likewise push the flap D outwardly, and pull the flap C inwardly. The outward movement of the flap B creates a compression in the spent gases trapped by this flap, and soon the trailing edge of the fin 432 just ahead of the flap B uncovers the exhaust port 471, and the spent gases are exhausted through this port. As flap C begins to move inwardly and creates a partial vacuum between this flap and the housing, the traling edge of the fin 432 just ahead of this flap uncovers the fuel inlet port 461, and the fuel mixture rushes in (or is injected in, if preferred) to fill this vacuum. The flap D is moving outwardly at this time, to compress the fuel previously trapped between the flap D and the stationary housing.

When the rotor rotates a little further in a clockwise direction, the parts get back to approximately the position shown in FIG. 9, although now the flap D has reached the firing position where the flap A is shown in FIG. 9, and flap A is now at the position B, and so on.

The cycle is repeated, and in a four flap engine, there are four combustion or power impulses during each revolution. The upper one of the two rollers 456, cooperating with the leading or forward edge of each flap as it approaches firing position, forces the flap outwardly to maximum compression position, and then when combustion occurs, the aft or trailing edge of the flange on the same flap rides down the upper roller 456 and pulls the rotor around. The lower one of the two rollers 456 assists the control links 477 in pushing the flap C out to its maximum outward position, to expel fully the spent gases through the exhaust port 471, preparatory to the intake of fresh fuel.

What is claimed is:

1. An internal combustion engine comprising a. a fixed casing defining a cylindrical chamber of substantially circular cross section therein, said casing having
   i. an intake port at one point in the periphery of said cavity,
   ii. an exhaust port at a different point in the periphery of said cavity, and
   iii. a firing member in communication with said cavity at a point intermediate said intake port and said exhaust port, b. a fixed shaft extending axially through said cavity substantially at the center thereof, c. a rotor mounted for rotation on said shaft within said cavity, d. a plurality of flaps pivotally mounted on said rotor and constituting movable wall means of expansion chambers defined by surfaces of said movable wall means and surfaces of said struts and said rotor plates and said casing, e. means for swinging said pivoted flaps on their pivots to provide respective expansion chambers of relatively large volume as the respective chambers pass said intake port during rotation of said rotor and to compress the respectively chambers to a smaller volume as the respective chambers closely approach said firing member, and for producing torque tending to turn said rotor relative to said shaft as the respective flaps are swung inwardly by pressure caused by combustion of contents of the respective chambers, f. said cam means comprising cooprating cam mechanism parts on said shaft and on at least one of said pivoted flaps for swinging one flap by contact of its part with a part of said shaft, and g. linkage means interconnecting one flap to a second flap to swing the second flap from movement of the first flap.

2. An internal combustion engine comprising a. a fixed casing defining a cylindrical chamber of substantially circular cross section therein, said casing having
   i. an intake port at one point in the periphery of said cavity,
   ii. an exhaust port at a different point in the periphery of said cavity, and
   iii. a firing member in communication with said cavity at a point intermediate said intake port and said exhaust port, b. a fixed shaft extending axially through said cavity substantially at the center thereof, c. a rotor mounted for rotation on said shaft within said cavity, said rotor having
   i. two circular plates both rotatably mounted on said shaft substantially parallel to and in axially spaced relation to each other, and
   ii. a plurality of rigid struts rigidly connecting said plates to each other at their outer peripheral edges at a plurality of points circumferentially spaced from each other, d. a plurality of flaps pivotally mounted on said rotor and constituting movable wall means of expansion chambers defined by surfaces of said movable wall means and surfaces of said struts and said rotor plates and said casing, and e. means for swinging said pivoted flaps on their pivots to provide respective expansion chambers of relatively large volume as the respective chamber pass said intake port during rotation of said rotor and to compress the respective chambers to a smaller volume as the respective chambers closely approach said firing member, and for producing torque tending to turn said rotor relative to said shaft as the respective flaps are swung inwardly by pressure caused by combustion of contents of the respective chambers, f. said last named means comprising linkage means connecting one of said flaps to another of said flaps to control movement of one flap from movement of the other flap.

3. An engine as defined in claim 2, wherein there are two flaps arranged diametrically opposite each other on said rotor, and the movement of one flap is controlled, during part of the rotation of the rotor, by contact of a part on such flap with a part mounted on said shaft, and movement of the other flap is controlled, during such part of the rotation of the rotor, by said linkage means.

4. An engine as defined in claim 2, wherein there are four flaps spaced at equal intervals around said rotor, and wherein movement of one flap is controlled, during part of the rotation of the rotor, by contact of a part on such flap with a part mounted on said shaft, and movement of the two flaps adjacent to such flap is controlled, during such part of the rotation of the rotor, by said linkage means.

5. An engine as defined in claim 4, wherein said linkage means interconnects all four of said flaps to each other.

6. An internal combustion engine comprising a. a fixed casing defining a cylindrical chamber of substantially circular cross section therein, said casing having
   i. an intake port at one point in the periphery of said cavity,
   ii. an exhaust port at a different point in the periphery of said cavity, and
   iii. a firing member in communication with said cavity at a point intermediate said intake port and said exhaust port, b. a fixed shaft extending axially through said cavity substantially at the center thereof, c. a rotor mounted for rotation on said shaft within said cavity, said rotor having
   i. two circular plates both rotatably mounted on said shaft substantially parallel to and in axially spaced relation to each other, and
   ii. a plurality of rigid struts rigidly connecting said plates to each other at their outer peripheral edges at a plurality of points circumferentially spaced from each other, d. a plurality of flaps pivotally mounted on said rotor and constituting movable wall means of expansion chambers defined by surfaces of said movable wall means and surfaces of said struts and said rotor plates and said casing, and e. means comprising a cam mechanism part on said shaft and a cooperating cam mechanism part on a pivoted flap for swinging said pivoted flaps on their pivots to provide respective expansion chambers of relatively large volume as the respective chambers pass said intake port during rotation of said rotor and to compress the respective chambers to a small volume as the respective chambers closely approach said firing member, and for producing torque tending to turn said rotor relative to said shaft as the respective flaps are swung inwardly by pressure caused by combustion of contents of the respective chambers, f. said cam mechanism part on said shaft including a roller mounted for rotation about an axis which is fixed relative to said shaft and eccentric relative thereto, and g. said cooperating cam mechanism part on a flap including a cam surface mounted on such flap and riding on said roller during part of the rotation of said rotor.

7. An engine as defined in claim 1, wherein said cam mechanism part on said shaft further includes a second roller mounted for rotation about an axis concentric with said shaft, and wherein said cam surface mounted on a flap rides successively on both of said rollers during part of the rotation of said rotor.

* * * * *